US006986557B2

(12) United States Patent
Kellenberger et al.

(10) Patent No.: US 6,986,557 B2
(45) Date of Patent: Jan. 17, 2006

(54) SLIDE SEGMENT WITH INTEGRAL BALL BEARING MOUNT

(75) Inventors: Daniel John Kellenberger, Chino Hills, CA (US); John Nan-Heng Young, Irvine, CA (US); Cesar Cordero Mallari, Corona, CA (US)

(73) Assignee: Jonathan Manufacturing Corporation, Irvine, CA (US)

( * ) Notice: Subject to any disclaimer, the term of this patent is extended or adjusted under 35 U.S.C. 154(b) by 86 days.

(21) Appl. No.: 10/224,616

(22) Filed: Aug. 19, 2002

(65) Prior Publication Data

US 2004/0032192 A1 Feb. 19, 2004

(51) Int. Cl.
*A47B 88/04* (2006.01)

(52) U.S. Cl. ..... 312/334.11; 312/334.8

(58) Field of Classification Search ..... 312/330.1, 312/334.1, 334.7, 334.11, 334.17, 334.25, 312/334.26, 334.12, 334.15, 334.16, 334.38; 384/18, 19, 20

See application file for complete search history.

(56) References Cited

U.S. PATENT DOCUMENTS

| | | | | | |
|---|---|---|---|---|---|
| 912,166 | A | | 2/1909 | Pomeroy | |
| 1,078,668 | A | | 11/1913 | Fraser | |
| 1,963,220 | A | * | 6/1934 | Anderson | 312/334.11 |
| 3,389,949 | A | * | 6/1968 | Stewart et al. | 312/334.11 |
| 4,537,450 | A | | 8/1985 | Baxter | |
| 4,929,097 | A | * | 5/1990 | Mottate | 384/49 |
| 5,472,272 | A | | 12/1995 | Hoffman | |
| 5,775,786 | A | * | 7/1998 | Liebertz | 312/334.8 |
| 5,871,265 | A | * | 2/1999 | Stewart et al. | 312/334.8 |
| 5,895,101 | A | | 4/1999 | Cabrales et al. | |
| 6,056,379 | A | | 5/2000 | Weng | |
| 6,238,031 | B1 | | 5/2001 | Weng | |
| 6,254,209 | B1 | | 7/2001 | Parvin | |
| 6,296,338 | B1 | | 10/2001 | Stijns | |
| 6,378,968 | B1 | * | 4/2002 | Weng | 312/334.11 |

FOREIGN PATENT DOCUMENTS

| | | | |
|---|---|---|---|
| GB | 2028109 | * | 3/1980 |

* cited by examiner

*Primary Examiner*—James O. Hansen
(74) *Attorney, Agent, or Firm*—Knobbe Martens Olson & Bear LLP

(57) ABSTRACT

A three-piece slide assembly includes an inner slide segment, an intermediate slide segment and an outer slide segment telescopingly engaged with one another. Desirably, the slide assembly is capable of supporting a 1U or 2U internet server and has a compact cross-sectional area, allowing it to fit within a 1"×⅜" cross-sectional envelope. Additionally, a single arrangement of upper bearings and a single arrangement of lower bearings desirably support substantially the entire load carried by the slide. Desirably, both the upper and lower bearings are carried by an intermediate slide segment and contact both the inner and outer slide segments when the slide is in a fully closed positioned. The slide assembly desirably includes an automatic sequencing arrangement wherein rotation of the bearings results in the intermediate slide segment extending along with the inner slide segment.

67 Claims, 6 Drawing Sheets

SLIDE SEGMENT WITH INTEGRAL BALL BEARING MOUNT

BACKGROUND OF THE INVENTION

1. Field of the Invention

The present invention relates generally to telescoping slide assemblies. More particularly, the present invention relates to a slide assembly that occupies a reduced cross-sectional area while maintaining a high load rating.

2. Description of the Related Art

Slide assemblies are commonly used to support an object, relative to a support structure, for linear motion between an accessible and a stored position. For example, drawers are usually supported by one or more slide assemblies for movement between an open and closed position relative to a cabinet, or other enclosure. Regardless of the application, it is generally desirable for the slide assembly to occupy as small an area as possible, while still providing sufficient strength, in order to maximize the dimensions of the drawer, or other object supported by the slide asembly.

One specific application in which a reduction of the cross-sectional area of the slide assembly is especially beneficial is the internet server market. In an internet server, the hardware components comprising the server are arranged and secured within a metal or a plastic enclosure, or chassis. The server/chassis assembly is then typically housed within an enclosed cabinet containing multiple servers arranged in a vertical manner. Each chassis is mounted on a pair of telescoping slides so that the server may be easily withdrawn from the cabinet for inspection, repair or replacement. It is contemplated that 1U and 2U servers will comprise the majority of the future internet server market.

A large number of cabinets, each containing multiple internet servers, often covering thousands, or tens of thousands, of square feet of floor space may be found in a single location. Storage costs for internet servers are typically calculated on a basis of square feet of floor space occupied per server. Accordingly, it is highly desirable to reduce the area occupied by the cabinets in order to maximize the number of cabinets, and thus servers, that may be stored in a given area.

One impediment to reducing cabinet dimensions has been the cross-sectional size of the available slide mechanism, or "slide", for short. Additionally, in an effort to reduce design and purchasing costs, it is desirable to provide a single slide that is suitable for both the 1U and 2U server applications. Therefore, a need exists for a slide of reduced cross-sectional area that is structurally capable of supporting a vertical load produced by either a 1U or 2U internet server.

In an internet server application, it is desirable to utilize an over-travel type slide assembly, which is capable of extending a distance greater than the length of any of the slide's individual segments. When utilizing an over-travel slide, the server may be completely withdrawn from the cabinet to permit access to the rearward end of the server where cables, such as power cables or connecting cables, may be located. A typical over-travel slide has three individual slide segments telescopingly engaged with one another. For example, an outer slide segment may be connected to the cabinet and an inner slide segment may be connected to the internet server chassis. An intermediate segment may interconnect the outer slide segment and the inner slide segment.

In a three piece slide assembly it is desirable for the individual slide segments to move in a specific sequence relative to one another. Specifically, it is highly undesirable for the inner segment to fully extend alone, before the intermediate slide segment begins to extend. Accordingly, the inner and intermediate slide segments are often coupled to move together, at least initially, when extending from the fully closed position of the slide. The inner and intermediate slide segments may be configured to frictionally engage one another to achieve the desired sequencing. Alternatively, a latch-type mechanism may be used to releasably connect the inner and intermediate slide segments.

However, as mentioned above, it is highly desirable to reduce the cross-sectional dimensions of the slide. To be strong enough to withstand the forces from repeated extensions of the slide assembly, latch-type mechanisms may necessarily be prohibitively large and prevent the slide assembly from having desirably small cross-sectional dimensions. Friction-type sequencing mechanisms are often unreliable in operation. For example, frictional forces between the outer and intermediate slide segments, due to the weight of the server, may be larger than the sequencing friction and allow the inner slide segment to extend alone.

An alternative method of sequencing extension of the slide segments is disclosed in U.S. Pat. No. 6,056,379 to Weng. The Weng slide assembly 1 is a three-piece, over-travel slide assembly having an inner slide segment 2, an intermediate slide segment 3 and an outer slide segment 4. An outer assembly of bearings includes both upper and lower bearings 5 positioned between the intermediate slide segment 3 and outer slide segment 4. An inner assembly of bearings includes both upper and lower bearings 6 between the intermediate slide segment 3 and inner slide segment 2.

A plurality of spherical members, or transmission members 7, are fixed for movement with the intermediate slide segment 3 as it extends and retracts. Each transmission member 7 contacts both the inner slide segment 2 and outer slide segment 4. Upper and lower sets of transmission members 7 are in contact with upper and lower end portions 8 of the inner slide segment 2 and upper and lower end portions 9 of the outer slide segment, respectively. Extension of the inner slide segment 2 results in rotation of the transmission members 7, as a result of being in contact with the end portions 8, which then roll on the end portions 9 of the outer slide segment 4. Because the intermediate slide segment 3 is fixed for movement with the transmission members 7, the rolling motion of the transmission members 7 causes extension of the intermediate segment 3 along with extension of the inner slide segment 2.

One problem with the Weng slide assembly 1 is that the provision of both outer bearings 5 and inner bearings 6 necessarily increases the height of the slide 1. As discussed above, a reduced cross-sectional envelope is highly desirable, especially in internet server mounting applications. An additional problem with the Weng slide assembly 1 is that, because both the outer and inner bearings 5, 6 and the transmission members 7 are positioned between the inner slide segment 2 and the outer slide segment 3, the tolerances of both the inner and outer segments 2, 3 must be precisely controlled in order to ensure that the transmission members 7 will properly contact both the end portions 8, 9 of the inner and outer segments 2, 4, respectively, which necessarily increases manufacturing costs. It may even be necessary to perform an additional manufacturing process step in order to ensure appropriate dimensions of the end portions 8, 9, which may increase the overall cost of the slide assembly 1 to a greater extent.

SUMMARY OF THE INVENTION

Accordingly, preferred embodiments of the present slide assembly are capable of supporting a 1U or 2U internet server and have a compact cross-sectional area, allowing it to fit within a 1"×⅜" cross-sectional envelope. Additionally, a single set of upper bearings and a single set of lower bearings desirably support substantially the entire load carried by the slide. Both the upper and lower bearings are carried by an intermediate slide segment and contact both the inner and outer slide segments when the slide is in a fully closed position. Accordingly, with such an arrangement, the bearings cause the intermediate slide segment to extend along with the inner slide segment. In addition, because only a single set of upper and lower bearings are positioned between the inner and outer slide segments, the slide assembly can be manufactured with typical tolerance ranges, thereby keeping the overall cost of the slide assembly low. Desirably, the slide assembly is an over-travel type assembly wherein the inner slide segment may be extended completely from the outer slide segment to permit access to the rearward end of an internet server mounted to the slide assembly. However, advantages of the present invention may also be realized with under-travel slide assemblies.

A preferred embodiment is a slide assembly including a first slide segment configured to carry a load and having a web, a first transverse section and a second transverse section spaced from one another along the web. The first transverse section defines a first contact surface and the second transverse section defines a second contact surface. A second slide segment is telescopingly engaged with the first slide segment. A third slide segment is configured to be connected to an object and is telescopingly engaged with the second slide segment. The third slide segment includes a web, a third transverse section and a fourth transverse section spaced from one another along the web. The third transverse section defines a third contact surface and the fourth transverse section defines a fourth contact surface. The slide is movable from a retracted position to an extended position, wherein the second slide segment is at least partially withdrawn from the third slide segment. A plurality of upper bearings and a plurality of lower bearings are carried by the second slide. At least one of the upper plurality of bearings and the lower plurality of bearings support substantially all load carried by the first slide segment. For example, desirably the slide is constructed such that the plurality of upper bearings and the plurality of lower bearings contact both the first and third slide segments in substantially any position of the slide assembly. In such an arrangement, the load carried by the first slide segment is supported by both the upper and lower bearings. However, in some arrangements, one or the other of the upper plurality of bearings or the lower plurality of bearings may primarily, or wholly, support the load carried by the first slide segment. For example, when the slide is in a fully retracted position, the load may be primarily, or wholly, supported by the lower plurality of bearings. Further, the upper bearings desirably contact both of the first contact surface and the third contact surface and the lower bearings contact both of the second contact surface and the fourth contact surface when the slide is in the retracted position.

A preferred embodiment is a slide assembly including a first slide segment having a web defining a vertical inner surface, a first transverse section and a second transverse section spaced from one another and extending in a first direction from the web. The first transverse section defines a first contact surface and the second transverse section defines a second contact surface. A second slide segment is telescopingly engaged with the first slide segment. A third slide segment is telescopingly engaged with the second slide segment and includes a web defining a vertical inner surface, a third transverse section and a fourth transverse section spaced from one another and extending from the web in a second direction opposite the first direction. The third transverse section defines a third contact surface and the fourth transverse section defines a fourth contact surface. The slide is movable from a retracted position to an extended position, wherein the second slide segment is at least partially withdrawn from the third slide segment. A plurality of upper bearings and a plurality of lower bearings are carried by the second slide segment and at least one of the upper plurality of bearings and the lower plurality of bearings support substantially all load carried by the first slide segment. The upper bearings contact both of the first contact surface and the third contact surface and the lower bearings contact both of the second contact surface and the fourth contact surface when the slide is in the retracted position. An exposed portion of the upper and lower plurality of bearings are not in contact with either of the first slide segment and the third slide segment when the slide is in the extended position. The second slide segment supports the exposed portion of the bearings. The upper bearings and the lower bearings are spaced inward in the first direction from the inner surface of the web of the first slide segment and the upper bearings and the lower bearings are spaced inward in the second direction from the inner surface of the web of the third slide segment.

A preferred embodiment is a slide assembly including a first slide segment configured to carry a load. The first slide segment has a web, a first transverse section and a second transverse section spaced from one another along the web. The first transverse section defines a first contact surface and the second transverse section defines a second contact surface. A second slide segment is telescopingly engaged with the first slide segment. A third slide segment is configured to be connected to an object and is telescopingly engaged with the second slide segment. The third slide segment includes a web, a third transverse section and a fourth transverse section spaced from one another along the web. The third transverse section defines a third contact surface and the fourth transverse section defines a fourth contact surface. The slide is movable from a retracted position to an extended position, wherein the second slide segment is at least partially withdrawn from the third slide segment. A plurality of upper bearings define centers arranged in no more than one plane, said plane being substantially perpendicular to said web of one of said first slide segment and said third slide segment, and a plurality of lower bearings define centers arranged in no more than one plane, said plane being substantially perpendicular to said web of one of said first slide segment and said third slide segment, and support the first slide segment relative to the third slide segment. The upper bearings and the lower bearings support substantially an entire load carried by the slide.

A preferred embodiment is a slide assembly including a first slide segment configured to carry a load. The first slide segment has a web, a first transverse section and a second transverse section spaced from one another along the web. The first transverse section defines a first contact surface and the second transverse section defines a second contact surface. A second slide segment is telescopingly engaged with the first slide segment. A third slide segment is configured to be connected to an object and is telescopingly engaged with the second slide segment. The third slide segment includes a web, a third transverse section and a fourth transverse section spaced from one another along the web. The third transverse section defines a third contact surface and the fourth transverse section defines a fourth contact surface. The slide is movable from a retracted position to an extended position, wherein the second slide segment is at least partially withdrawn from the third slide segment. A plurality of upper bearings and a plurality of lower bearings are carried by the second slide segment and at least one of the plurality of upper bearings and the plurality of lower bearings supports substantially all load carried by the first slide segment. The upper bearings contact both of the first contact surface and the third contact surface and the lower bearings contact both of the second contact surface and the fourth contact surface when the slide is in the retracted position. The second slide segment is at least two-thirds of the length of one of the first slide segment and the third slide segment.

A preferred embodiment is a slide assembly including a first slide segment configured to carry a load. The first slide segment has a web, a first transverse section and a second transverse section spaced from one another along the web. The first transverse section defines a first contact surface and the second transverse section defines a second contact surface. A second slide segment is telescopingly engaged with the first slide segment. A third slide segment is configured to be connected to an object and is telescopingly engaged with the second slide segment. The third slide segment includes a web, a third transverse section and a fourth transverse section spaced from one another along the web. The third transverse section defines a third contact surface and the fourth transverse section defines a fourth contact surface. The slide is movable from a retracted position to an extended position, wherein the second slide segment is at least partially withdrawn from the third slide segment. A plurality of upper bearings define centers arranged in no more than one plane, said plane being substantially perpendicular to the web of one of the first and third slide segments, and a plurality of lower bearings define centers arranged in no more than one plane, said plane being substantially perpendicular to the web of one of the first and third slide segments. The upper bearings and the lower bearings support the first slide segment relative to the third slide segment and at least one of the plurality of upper bearings and the plurality of lower bearings support substantially all load carried by the slide. The second slide segment is at least two-thirds the length of one of the first slide segment and the third slide segment.

A preferred embodiment is a slide assembly having a first slide segment configured to be connected to a first object. The first slide segment has a web, a first transverse section and a second transverse section spaced from one another along the web. The first transverse section defines a first contact surface and the second transverse section defines a second contact surface. A second slide segment is configured to be connected to a second object. The second slide segment is telescopingly engaged with the first slide segment and includes a web, a third transverse section and a fourth transverse section spaced from one another along the web. A plurality of upper bearings are held in a fixed location relative to the third transverse section and are rotatable relative to the third transverse section. A plurality of lower bearings are held in a fixed location relative to the fourth transverse section and are rotatable relative to the fourth transverse section. At least one of the plurality of upper bearings and the plurality of lower bearings support substantially all load carried by the slide assembly.

BRIEF DESCRIPTION OF THE DRAWINGS

The above-mentioned, and other features of the invention, are described with reference to the drawings of a preferred embodiment of the present invention. The illustrated embodiment of the slide assembly is intended to illustrate, but not to limit, the invention. The drawings contain nine figures.

In FIG. 5, the slide assembly is shown in a closed position;

DETAILED DESCRIPTION OF THE PREFERRED EMBODIMENT

A slide constructed in accordance with the present invention finds utility in a wide variety of applications. As will be appreciated by one of skill in the art, the slide assembly may comprise an under-travel arrangement, or an over-travel arrangement, and may be configured for vertical mounting, or other mounting orientations. However, a preferred embodiment of the slide disclosed herein is particularly well suited for use in computer hardware applications and, in particular, for mounting 1U and 2U internet servers within a server cabinet. Accordingly, the present slide assembly is described in the environment of internet server mounting, however, such a description of use is not intended to limit the present invention.

The individual hardware components comprising an internet server are typically housed within a chassis. When the term server is used herein, it is typically intended to include the server/chassis assembly, unless otherwise indicated. A 1U server has approximate dimensions (width×depth×height) of 19"×22½"×1¾" and may weigh approximately 30–35 pounds. A 2U server is typically 19"×20½"×3½" and may weigh approximately 60–75 pounds. However, preferably, a slide assembly constructed in accordance with principles disclosed herein is capable of supporting an operating load of approximately 100 pounds. Such an arrangement provides a slide assembly having sufficient strength to permit use with either a 1U or 2U server, and also provides a factor of safety. As a result of the increased volume of slides produced due to providing a single slide design for both the 1U and 2U server markets, design and manufacturing costs may be reduced.

Figure 2:
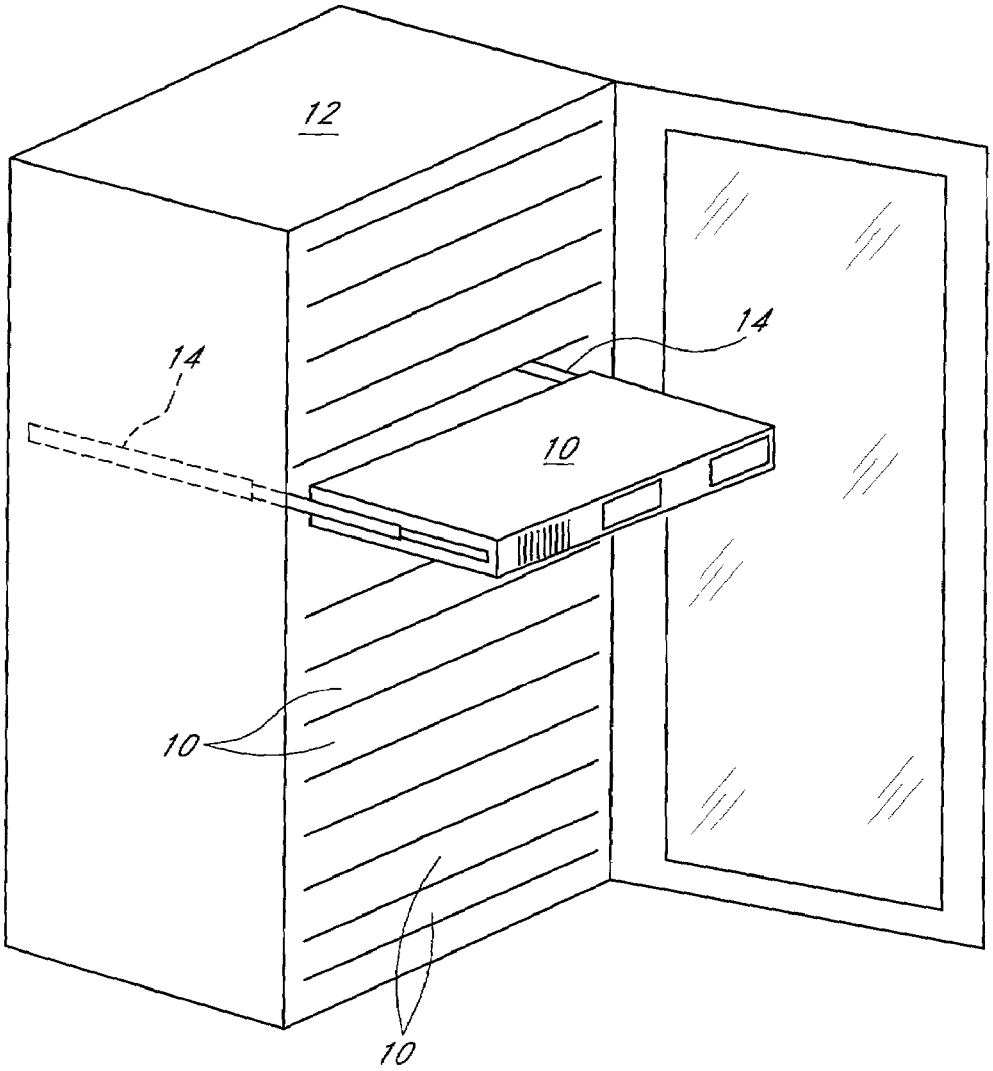
FIG. 2 is a perspective view of an internet server cabinet with one server in a withdrawn position from the cabinet. The server is shown mounted to the cabinet with a pair of preferred slides.

FIG. 2 illustrates a plurality of internet servers 10 held within a cabinet 12. Each server 10 is connected to the cabinet 12 by a pair of slides 14. The slides 14 are constructed for translation between a fully retracted position and a fully extended position. A single server 10 is illustrated with its related pair of slides 14 in a fully extended position. As discussed above, the slides 14 preferably are constructed such that in their fully extended position the server 10 is completely withdrawn from the cabinet 12. Advantageously, such an arrangement allows easy access to the server 10 for purposes such as installation, modification or repair. As discussed in detail below, the slides 14 are constructed with sufficient strength to support a 1U or 2U server while, at the same time, occupying a minimum amount of space. Such an arrangement advantageously reduces wasted space (i.e., non-server space) within the cabinet 12, allows the cabinet 12 to be constructed with reduced dimensions and, thus, maximizes the number of servers that may occupy a given area.

Figure 3:
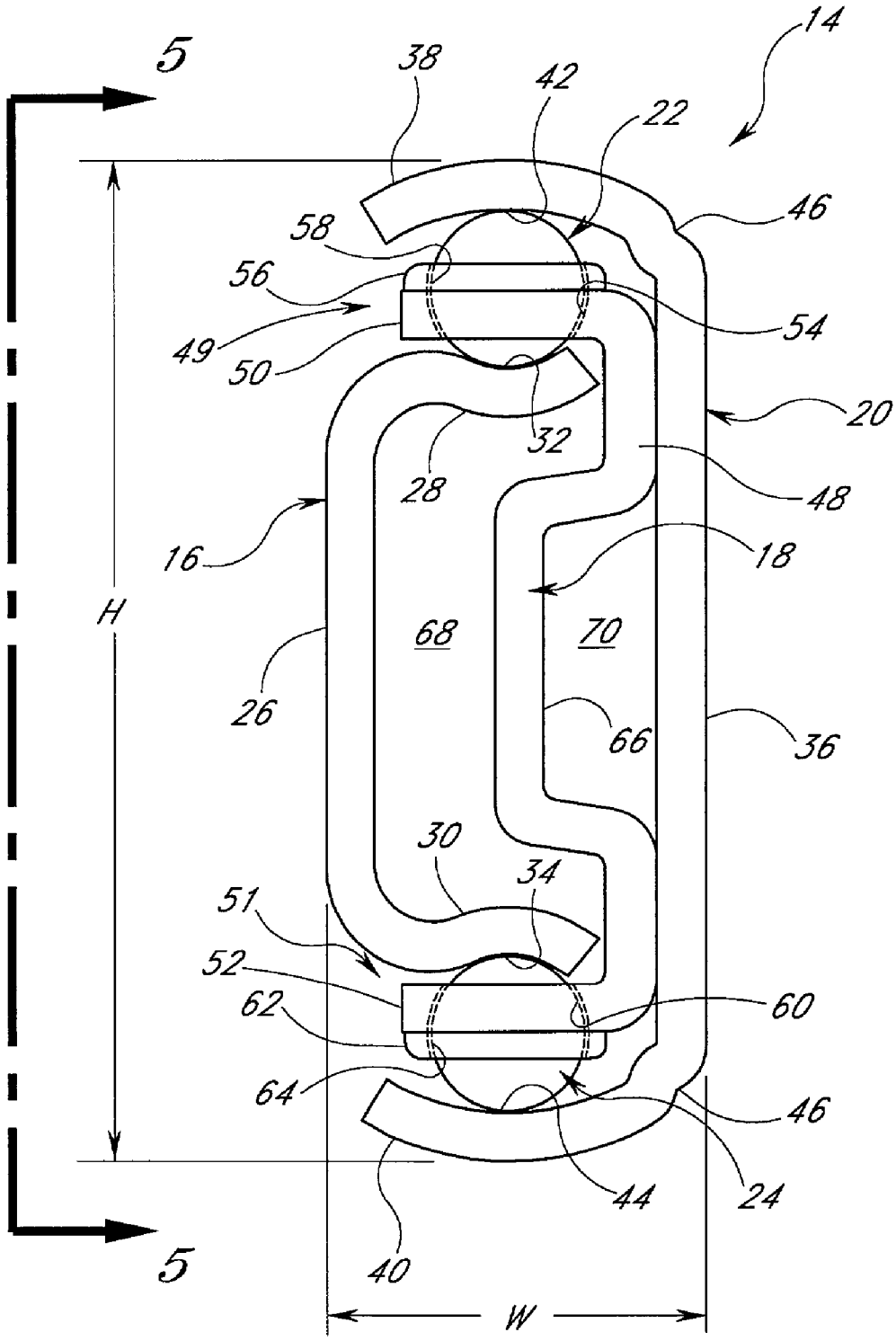
FIG. 3 is a cross-sectional view of the slide assembly shown in FIG. 2. The slide assembly includes an inner slide segment, an intermediate slide segment and an outer slide segment telescopingly engaged with one another. The inner and outer segments are separated from one another by upper and lower bearings, which are carried by the intermediate slide segment.

With reference to FIG. 3, a preferred slide assembly 14 is shown in section. The slide assembly 14 includes an inner slide segment 16, an intermediate slide segment 18 and an outer slide segment 20. An upper arrangement of bearings 22 and a lower arrangement of bearings 24 support the outer slide segment 20 relative to the inner slide segment 16. Desirably, both the upper and lower bearings 22, 24 are carried by, or fixed for motion with, the intermediate slide segment 18. With reference to FIGS. 4–7, both the upper and lower bearings 22, 24 desirably comprise a plurality of individual bearing members, or ball bearings spaced from one another along the length of the slide 14.

With reference to FIG. 3, the inner slide segment 16 includes a substantially vertical web 26 extending between an upper transverse section 28 and a lower transverse section 30. The upper transverse section 28 desirably is curved and includes an upper curved surface 32 that defines a contact surface, or bearing race, for supporting the upper bearings 22. Similarly, the lower transverse section 30 desirably is curved and includes a lower curved surface 34 that defines a contact surface, or bearing race, for supporting the lower bearing 24. In addition, the curved shape of the upper and lower transverse sections 28, 30 inhibits lateral, or transverse, movement of the inner slide segment 16 (i.e., movement in the horizontal direction in the vertical slide illustrated in FIG. 3).

The outer slide segment 20 also includes a vertical web 36 extending between upper and lower transverse sections 38, 40, respectively. The upper and lower transverse sections 38, 40 of the outer slide segment 20 extend in an opposite direction from the transverse sections 28, 30 of the inner slide segment 16. The upper transverse section 38 of the outer slide segment 20 includes a curved lower surface that defines a curved contact surface 42, or bearing race, for supporting the upper bearings 22. Similarly, the lower transverse section 40 of the outer slide segment 20 includes a curved upper surface that defines a contact surface 44, or bearing race, for the lower bearings 24. The curved shape of the upper and lower transverse sections 38, 40 inhibits lateral, or transverse, movement of the outer slide segment 20.

Desirably, strengthening ribs 46 are located generally at the transition between the vertical web 36 and both the upper and lower transverse sections 38, 40 of the outer slide segment 20. Preferably, the strengthening ribs 46 extend approximately the entire length of the outer slide segment 20. Advantageously, the strengthening ribs 46 increase the resistance of the outer slide segment 20, and the entire slide assembly 14, from flexing due to bending and/or torsional forces. In addition, the strengthening ribs 46 inhibit outward flexing of the transverse sections 38, 40 of the outer slide segment 20 thereby preventing undesired vertical movement, or play, of the inner and intermediate slide segments 16, 18.

The intermediate slide segment 18 also includes a vertical web 48 extending between an upper transverse section 49 and a lower transverse section 51. Preferably, the upper and lower transverse sections 49, 51 of the intermediate slide segment 18 extend away from the vertical web 48 in the same direction as the upper and lower transverse sections 38, 40 of the outer slide segment. In addition, the vertical web 48 of the intermediate slide segment 18 is positioned generally between a vertical web 26 of the inner slide segment 16 and the vertical web 36 of the outer slide segment 20.

Figure 4:
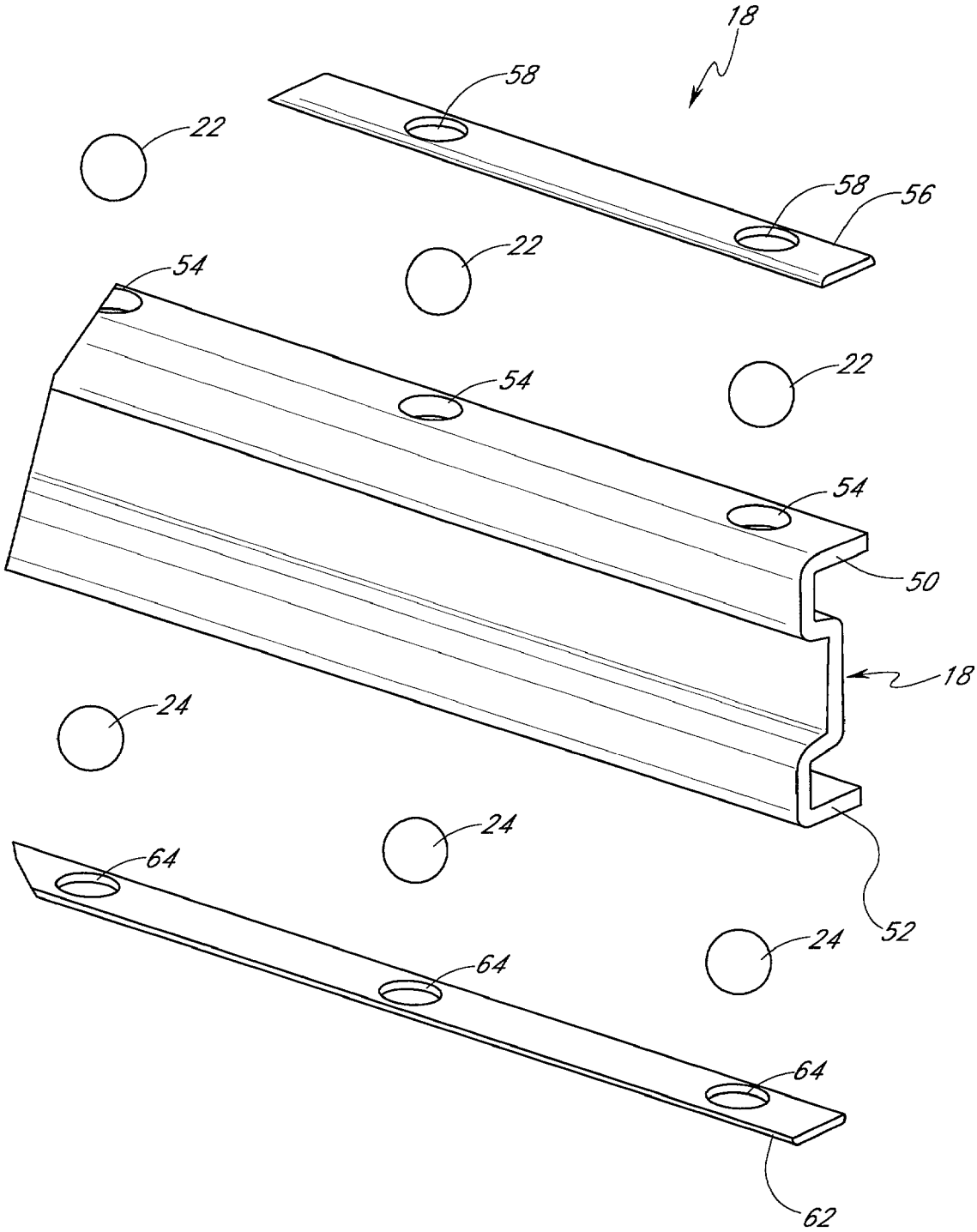
FIG. 4 is an exploded assembly view of the intermediate slide segment, upper and lower bearings and upper and lower bearing retainers.

With reference to FIGS. 3 and 4, desirably, the upper transverse section 49 includes a first portion 50 and a second portion 56, which cooperate to support the upper bearings 22. That is, the first and second portions 50, 56 hold the bearings 22 for movement with the intermediate slide segment 18 and substantially prevent vertical movement of the bearings 22. Each upper bearing 22 is received within an aperture 54, which passes vertically through the first portion 50. The first portion 50 defines the surface of the aperture 54, which desirably is spherical in shape to generally conform to the outer surface of the upper ball bearing 42. Preferably, the maximum diameter of the aperture 54 is located at the upper surface of the first portion 50 and is approximately equal to the diameter of the upper bearing 42 such that the upper bearing 42 may only pass approximately halfway through the aperture 54. That is, approximately one-half of the upper bearing 42 is positioned above the upper surface of the first portion 50.

A second portion 56 of the upper transverse section 49 is attached to the first portion 50 and includes a spherical aperture 58, which generally corresponds with the aperture 54 of the first portion 50. The maximum diameter of the aperture 58 desirably is located at the lower surface of the second portion 56 and the diameter reduces when moving upward through the aperture 58.

As described above, the aperture 54 of the first portion 50 and the aperture 58 of the second portion 56 cooperate to retain the upper bearing 22 in substantially all directions, while permitting the bearing to rotate. Thus, the upper bearing 22 may rotate in response to linear movement of the inner slide segment 16, as is described in greater detail below.

Similarly, the lower transverse section 51 of the intermediate slide segment 18 includes a first portion 52 and a second portion 62 which cooperate to support the lower bearings 24 in a manner similar to that described above in relation to the upper transverse section 49. The first portion 52 includes a spherical aperture 60, which prevents the lower bearing 24 from moving in an upward direction. The second portion 62 includes a spherical aperture 64 that cooperates with the aperture 60 and prevents the lower bearing 24 from moving in an upward direction. As mentioned above, desirably the upper and lower bearing arrangements 22, 24 comprise a plurality of bearings, each retained in their respective apertures.

Preferably, the vertical web 26 of the inner slide segment 16 and the vertical web 36 of the outer slide segment 20 define a width W of the slide assembly 14. The upper transverse section 38 and the lower transverse section 40 of the outer slide segment 20 define a height H of the slide assembly 14. Advantageously, with the arrangement described above, the slide assembly 14 is capable of supporting a 1U or 2U internet server while fitting within a relatively small cross-sectional envelope. Desirably, the height H is approximately one inch and the width W is approximately three-eighths of an inch. However, as will be appreciated by one of skill in the art, the dimension of the slide assembly 14 may be altered to suit a particular application.

As illustrated in FIGS. 3 and 4, preferably the upper bearings 22 are aligned with one another in both a vertical direction (i.e., in the direction of the height H) and a lateral direction (i.e., in the direction of the width W). Similarly, it is preferred that the lower bearings 24 are aligned with one another in both a vertical and a lateral direction. Additionally, it is preferred that the upper bearings 22 are aligned with the lower bearings 24 in the lateral direction. Such an arrangement allows the slide assembly to have a compact cross-section. Although the above-described arrangement is preferred, other arrangements may also be utilized wherein the upper and/or lower bearings are not aligned.

Desirably, a central portion 66 of the vertical web 48 of the intermediate slide segment 18 is off-set from the remainder of the vertical web 48 and is located approximately an equal distance from the vertical web 26 of the inner slide segment 16 and the vertical web 36 of the outer slide segment 20. Accordingly, a space 68 is defined between the vertical web 26 and the vertical web 66. Similarly, a space 70 is defined between the vertical web 66 and the vertical web 36. Typically, in an internet server environment, the outer slide segment 20 is connected to the server cabinet 12 (FIG. 2) and the inner slide segment 16 is connected to the internet server 10 (FIG. 2). The spaces 68, 70 provide clearance for fastening members utilized to connect the server 10 and the cabinet 12 to the slide assembly 14, as is well known in the art. The above-described arrangement permits the spaces 68, 70 to be sized such that common mounting fasteners may be utilized despite the desirably small cross-sectional envelope of the slide assembly 14.

FIG. 4 is an exploded assembly view of the intermediate slide segment 18. As illustrated, both the upper and lower second portions, or retainers 56, 62, are relatively flat, elongated pieces, which are sized and shaped to generally conform to the upper surface of the upper first portion 50 and lower surface of the lower first portion 52, respectively. The upper and lower retainers 56, 62 may be attached to the intermediate segment 18 by any suitable method. For example, the upper and lower retainers 56, 62 may be secured to the intermediate slide segment 18 through a welding process, such as spot welding, for example. Alternatively, mechanical fasteners, such as rivets, may also be used.

Figure 5:
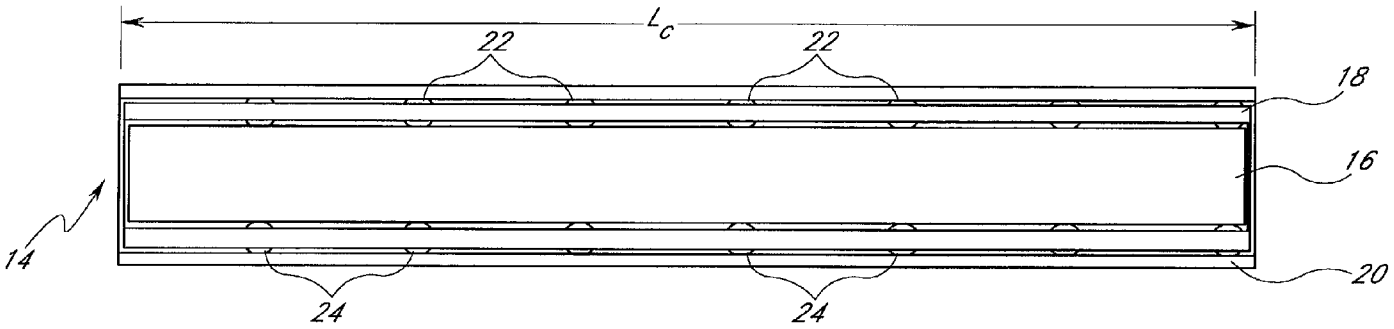
FIG. 5 is a side view of the slide assembly taken along the line 5—5 of FIG. 3.

FIG. 5 is a side plan view of the slide assembly in a fully closed, or retracted position. In the closed position, the slide assembly 14 defines a length $L_C$ approximately equal to the length of the individual segments 16, 18, 20. Further, desirably the length of the intermediate slide segment 18 is equal to at least a significant portion of the length of either the inner segment 16 and outer slide segment 20. With such an arrangement, when the slide is in an over-travel position, the load applied to each of the inner and outer slide segments 16, 20 by the intermediate slide segment 18 is spread over a significant length of the inner and outer segments 16, 20. Accordingly, the slide 14 is capable of supporting a relatively large amount of weight in an over-travel position without damaging either the inner or outer slide segments 16, 18. Desirably, the intermediate slide segment 18 is at least two-thirds the length of either the inner or outer slide segments 16, 20. Preferably, the intermediate slide segment 18 is at least three-quarters the length of either the inner or outer slide segments 16, 20 and, more preferably, is at least four-fifths the length of either the inner or outer slide segments 16, 20. Most preferably, as illustrated in FIG. 5, the intermediate slide 18 is approximately the same length as the inner slide segment 16 and the outer slide segment 20.

In addition, because the load is transmitted between the individual slide segments 16, 18, 20 by the bearings 22, 24, it is desirable that at least five upper and five lower bearings 22, 24 are provided. Such an arrangement spreads the load applied to the inner and outer segments 16, 20 over a larger area. Preferably, at least ten each of upper bearings 22 and lower bearings 24 are provided. More preferably, at least fifteen of each upper bearings 22 and lower bearings 24 are provided and, most preferably, at least twenty each of upper bearings 22 and lower bearings 24 are provided. Further, it is also desirable that the bearings 22, 24 are spread out over a significant length of the intermediate slide segment 18 in order to spread the load applied to the inner and outer segments 16, 20 over a larger area. Desirably, both the upper bearings 22 and lower bearings 24 are spread over at least one half the length of the intermediate slide 18. More desirably, the bearings are spread over at least two-thirds and, preferably, over at least three-quarters of the slide segment 18. More preferably, the bearings are spread out over at least four-fifths of the intermediate segment 18 and, in some applications, may even be spread out over the entire length of the intermediate segment 18.

Figure 6:
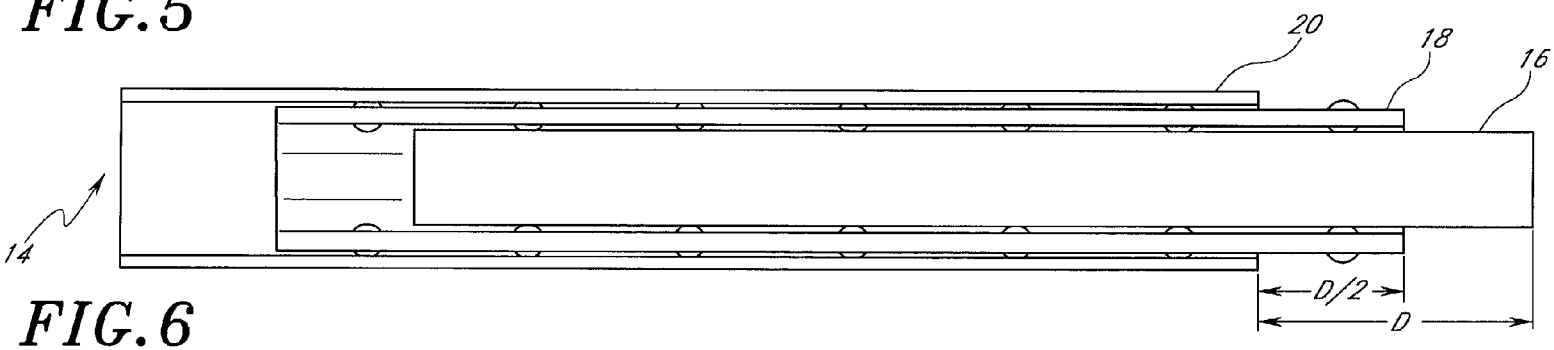
FIG. 6 is a side view of the slide assembly in a partially open position.

FIG. 6 illustrates the slide assembly 14 in a partially extended position. As the inner slide segment 16 is extended, rotational motion is imparted to the upper and lower bearings 22, 24, due to the contact between the bearing contact surfaces 32, 34 (FIG. 3) of the inner slide segment 16. As a result, the upper and lower bearings 22, 24 roll along the bearing contact surfaces 42, 44 of the outer slide segment 20. Because the bearings are held by the intermediate slide segment 18, as described above, motion is imparted to the intermediate slide segment 18 as the inner slide segment 16 is extended with respect to the outer slide segment 20 due to the rolling motion of the bearings 22, 24. Advantageously, such an arrangement ensures that the inner slide segment 16 does not extend alone. Instead, the intermediate slide segment 18 moves toward an extended position, along with the inner slide segment 16.

As illustrated in FIG. 6, because at least a portion of the upper and lower bearings 22, 24 contact both of the inner segment 16 and the outer segment 20 (until approximately when over-travel begins), the intermediate slide segment 18 moves about one-half the distance that the inner slide segment 16 moves. For example, if the inner slide segment 16 is extended from a fully closed position of the slide 14 a distance of D, the intermediate slide segment 18 is extended approximately one-half the distance D, or D/2. Once an over-travel position is reached (i.e., the inner segment 16 is completely withdrawn from the outer segment 20), no individual bearing 22, 24 is in contact with both of the inner and outer segments 16, 20 and, as a result, no motion is imparted to the intermediate segment 18 through the bearings 22, 24.

Figure 7:
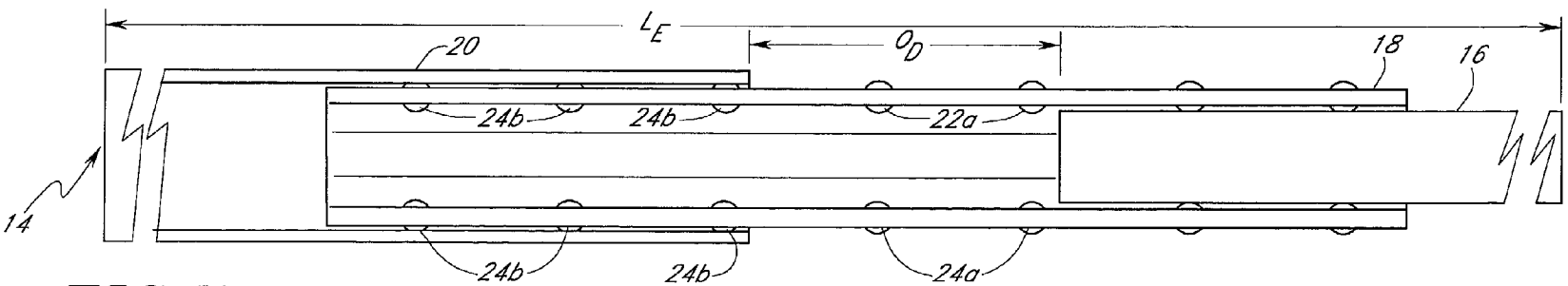
FIG. 7 is a side view of the slide assembly in a fully open, or extended, position.

With reference to FIG. 7, the slide assembly 14 is shown in a fully extended position. In the fully extended position, the slide assembly 14 defines an extended length $L_E$, which desirably is greater than the length of any individual slide segments 16, 18, 20. Thus, when the slide assembly 14 is in its fully extended position, a distance $O_D$ is defined between the outer slide segment 20 and the inner slide segment 16. The distance $O_D$ is referred to as the over-travel distance, as is well known in the art.

Although the illustrated slide assembly 14 is an over-travel slide, an under-travel slide assembly may also be provided in accordance with the present invention. In an under-travel slide assembly, the inner slide segment is not completely withdrawn from the outer slide segment when the slide is in a fully extended position. In addition, although a three-piece slide assembly 14 is shown, the slide may comprise additional slide segments. For example, more than one intermediate slide segment may be provided, as will be appreciated by one of skill in the art.

As is known in the art, when an over-travel slide assembly is in a fully extended position, the intermediate slide segment must be capable of withstanding substantially the entire load carried by the slide without permanently deforming and, preferably, without significant deflection. Preferably, the intermediate slide segment 18 of the illustrated slide assembly 14 is configured to support an operating load of at least thirty pounds being carried by the slide 14 without permanent deformation. More preferably, the intermediate slide segment 18 is configured to support an operating load of at least seventy five pounds being carried by the slide 14 without permanent deformation. As will be apparent to one of skill in the art, in other slide applications, the intermediate slide segments may be configured to support a lesser, or much greater, load.

Advantageously, as described above, the bearings 22, 24 are retained in both an upward and downward vertical direction by the upper and lower transverse sections 49, 51. Accordingly, when the slide 14 is in a fully extended position, a portion of the bearings 22*a*, 24 that may not be in contact with the either the inner segment 16 or the outer segment 20 are nonetheless secured to the intermediate slide segment 18 and are prevented from being displaced from the slide assembly 14. Similarly, the bearings 22*b*, 24*b* that are in contact with the outer slide segment 20, but not the inner slide segment 16, are also secured to the intermediate slide segment 18.

As will readily be determined by one of skill in the art, any of a number of suitable stop mechanisms may be utilized to define fully closed and/or fully extended positions of the slide assembly 14, or any two segments thereof. Additionally, if desired, any suitable type of lock mechanism may be utilized to releasably secure the slide assembly 14, or any two segments of the slide 14, in a fully closed and/or fully extended position.

Figure 1:
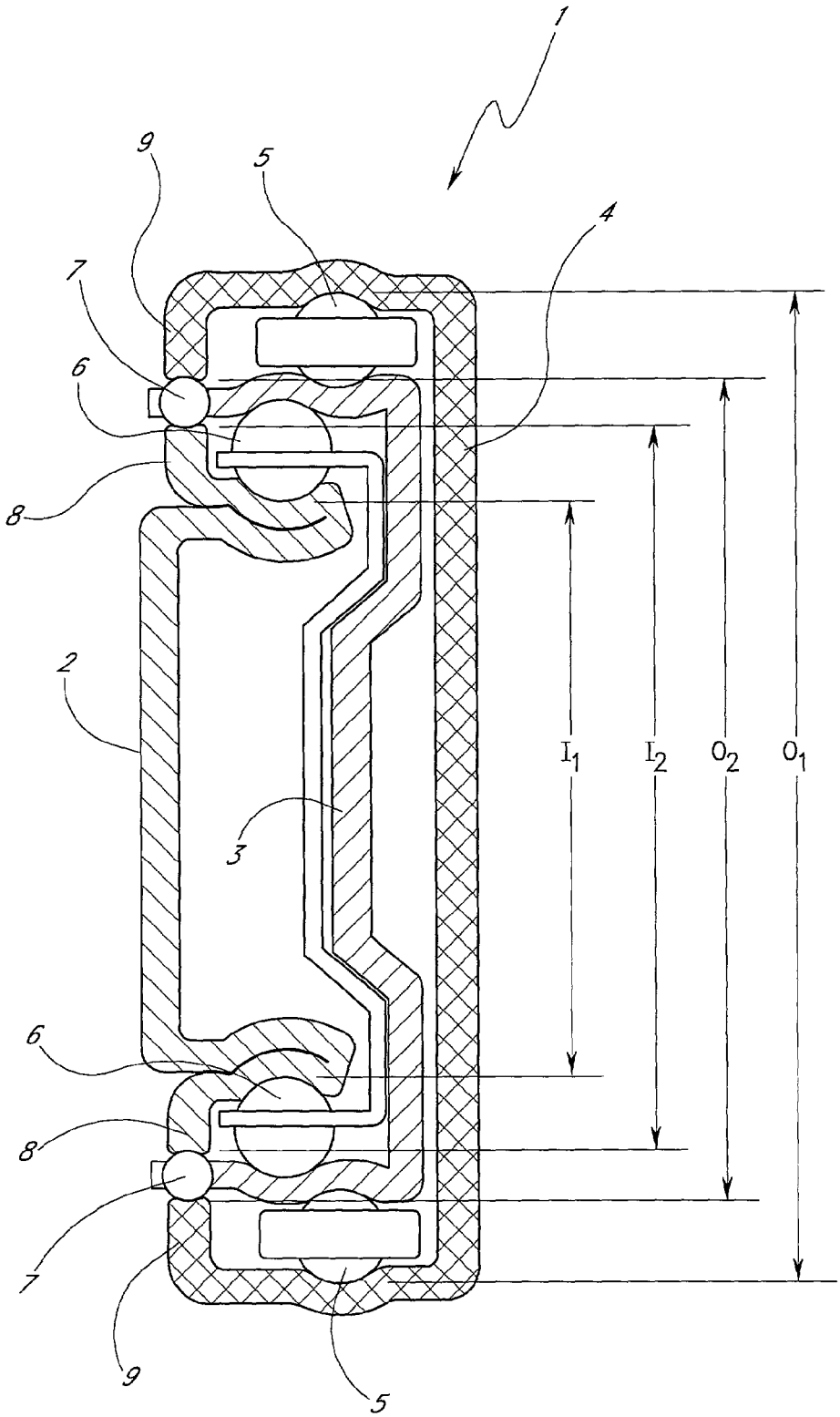
FIG. 1 (PRIOR ART)
FIG. 1 is a cross-sectional view of a prior art slide assembly.

With reference to FIG. 1, as discussed above, the Weng slide assembly 1 has several disadvantages that make it undesirable for general use, and especially in internet server mounting applications. For example, incorporating both an outer set of bearings 5 and an inner set of bearings 6 increases the overall height of the slide assembly 1. As a result, it may not be possible for such a slide assembly 1 to both be strong enough to reliably carry the load of a 1U or 2U internet server and fit within the 1"×⅜" cross-sectional envelope, which is presently preferred within the internet server industry.

In addition, as discussed above, the dimensions of the Weng slide assembly 1 must be held within a precise range to ensure appropriate contact between the transmission members 7 and the inner and outer slide segments 2, 4. As a result, it may not be possible to manufacture a slide assembly 1 as shown in the Weng patent at an economically feasible cost.

Specifically, both the inner slide segment 2 and the outer slide segment 4 of the Weng slide assembly 1 have two critical vertical dimensions in order to ensure proper functioning of the slide 1. First, as with many slide assemblies, a vertical distance $O_1$ between the bearing surfaces of the transverse sections of the outer slide segment 4 and a vertical distance $I_1$ between the bearing surfaces of the inner slide segment 2 are important to permit proper functioning of the slide assembly 1. Desirably, the difference between the distances $O_1$ and $I_1$ is large enough to accommodate the bearings 5, 6 and transverse section of the intermediate slide segment 3 to allow the slide 1 to extend with low resistance, yet not so large as to permit excessive vertical movement of the inner and outer segments 2, 4 relative to one another.

Unlike many other slide assemblies, however, a distance $O_2$ between the end portions 9 of the outer segment 4 and a distance $I_2$ between the end portions 8 of the inner segment 2 are also critical to proper functioning of the sequencing action of the slide assembly 1. The difference between the distances $O_2$ and $I_2$ must be large enough to accommodate the transmission members 7, yet still permit the members 7 to contact both respective end portions 8, 9 of the inner and outer slide segments 2, 4.

Common manufacturing methods may be unable to hold the above-described dimensions $O_1$, $I_1$ and $O_2$, $I_2$ within a tolerance range necessary to ensure proper, consistent motion of the slide assembly 1, at least without necessitating additional process steps, which increase the manufacturing cost. For example, the individual slide segments of a slide assembly are commonly manufactured by a roll-forming process wherein a flat piece of metal is passed through a progression of rollers, which incrementally deform the flat piece of material into the desired final shape. Due to normal variation in the width of the initially flat piece of material and normal variations in the roll-forming process itself, if the first critical dimensions $O_1$ and $I_1$ are controlled, it is likely that the second critical dimensions $O_2$ and $I_2$ will not be held within the necessary tolerance range to permit proper sequencing action of the slide 1. It is likely that an additional machining process will be necessary to remove such variation to achieve the desired critical dimensions $I_2$, $O_2$ of one or both of the end portions 8, 9 of the inner and outer segments 2, 4. As a result, the overall manufacturing cost of the slide assembly 1 is increased.

Another disadvantage of the Weng slide assembly 1 is that no means is disclosed for securing the transmission members 7 vertically with respect to the intermediate slide segment 3. As a result, when any one of the transmission members 7 is not secured vertically between the inner and outer segments 2, 4 (i.e., when the inner slide segment 2 is extended), the transmission member 7 will fall from the intermediate slide segment 3 due to the force of gravity.

In contrast, the present slide assembly 14 overcomes the above-described disadvantages of the Weng slide assembly 1. For instance, by utilizing only a single arrangement each of upper and lower bearings 22, 24, the illustrated slide assembly 14 is capable of both supporting either a 1U or 2U internet server and fitting within the desired 1"×⅜" cross-sectional envelope. In addition, the bearings 22, 24 support the load carried by the slide 14 and cause extension, or sequencing movement, of the intermediate slide segment 18.

Additionally, the inner segment 16 and the outer segment 18 are separated by only the upper and lower bearings 22, 24. Accordingly, with reference to FIG. 3, the upper transverse section 28 of the inner segment 16 and the upper transverse section 38 of the outer segment 20 are separated by only two spherical surfaces (i.e., the upper and lower surfaces of the upper bearing 22). Similarly, the lower transverse section 30 of the inner segment 16 and the lower transverse section 40 of the outer segment 20 are separated by only two spherical surfaces (i.e., the upper and lower surfaces of the lower bearing 24). As a result, normal manufacturing practices may be used to shape the individual segments 16, 18, 20, without requiring additional manufacturing steps. That is, there is no critical vertical dimension necessary to accommodate a transmission mechanism in addition to the necessary vertical dimension, common to most slide assemblies, for accommodating the load-carrying bearings.

Furthermore, the present slide assembly 14 also secures the bearings 22, 24 vertically with respect to the intermediate slide segment 18, as described above. Such an arrangement prevents the bearings 22, 24 from being displaced from the slide assembly 14 when they are not in contact with both of the inner and outer segments 16, 20, such as when the slide 14 is in an over-travel position (FIG. 7). Advantageously, such an arrangement eliminates the need for a separate bearing cage member to secure the bearings in contact with either the inner or outer slide segment, thereby reducing the cost of the final assembly.

Figure 8:
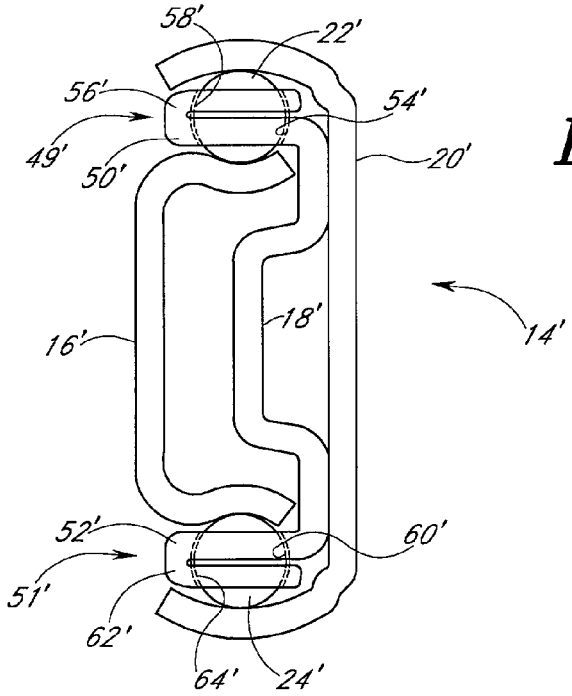
FIG. 8 is a cross-sectional view of a variation of the slide assembly of FIGS. 2–7 including a alternate intermediate slide segment.

FIG. 8 illustrates an alternative configuration of the slide assembly 14 of FIGS. 2–7 and is generally referred to by the reference numeral 14'. The slide 14' is substantially similar in construction and operation to the slide 14 of FIGS. 2–7 and, therefore, like reference numerals are used to describe like components, except that a prime (') is added.

In the intermediate slide segment 18' of FIG. 8, both the upper and lower second portions 56', 62' of the upper and lower transverse sections 49', 51' are formed from the same piece of material as the intermediate segment 18', including the first portions 50', 52'. Advantageously, such an arrangement reduces the overall number of components in the slide assembly 14', thereby reducing the overall cost. In addition, assembly of the bearings 22', 24' into the intermediate slide segment 18' is simplified in comparison to the arrangement of FIGS. 2–7.

Figure 9A:
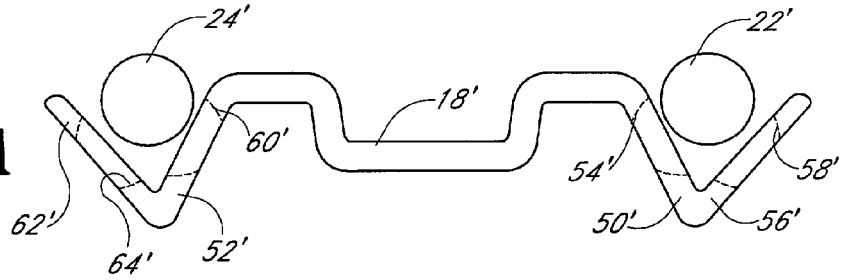
FIGS. 9A–9C are a series of cross-sectional views illustrating a method for fabricating the alternate intermediate slide segment of FIG. 8.
Figure 9B:
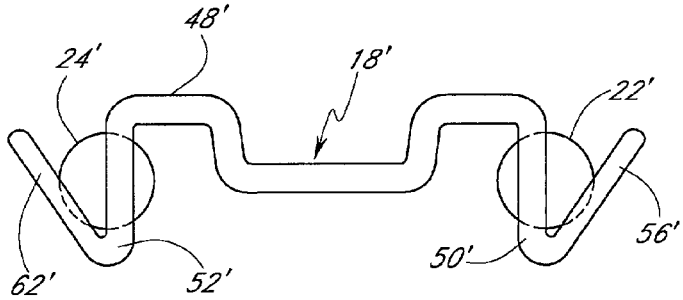
Figure 9C:
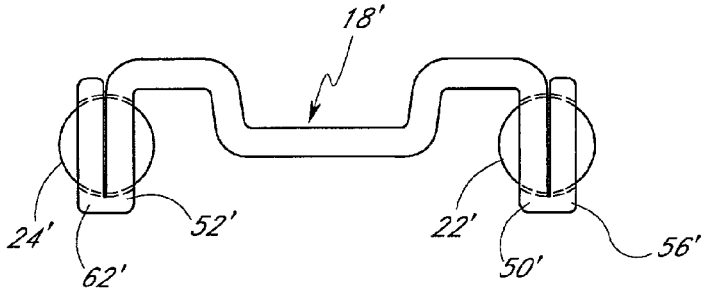

FIGS. 9A–9C illustrate one method for fabricating the intermediate slide segment 18' of FIG. 8 and assembling the bearings 22', 24' into the segment 18'. With reference to FIG. 9A, desirably the intermediate segment 18' is partially shaped by a suitable process, such as a roll-forming process for example, such that the first portions 50', 52' are angled from the second portions 56', 62' a sufficient distance such that the bearings 22', 24' may be positioned therebetween. Preferably, the angle between the first portions 50', 52' and the second portions 56', 62' is small enough such that the bearings 22', 24' are at least partially positioned within one, or both, of the apertures 54', 60' of the first portions 50', 52' and/or apertures 58', 64' of the second portions 56', 62' and are thereby held in a desired position.

With reference to FIG. 9B, the transverse sections 50', 52' are formed in an inward direction toward a position transverse with respect to the web 48' of the intermediate slide segment 18'. In addition, desirably the second portions 56', 62' are formed inward toward the first portions 50', 52'. Subsequently, and with reference to FIG. 9C, the second portions 56', 62' are further formed until they are generally adjacent the first portions 50', 52' and the bearings 22', 24' are secured within the apertures 54', 60' of the first portions 50', 52' and the apertures 58', 64' of the second portions 56', 62'. If desired, the second portions 56', 62' may then be secured to the first portions 50', 52' by a suitable means, such as welding or mechanical fasteners, for example.

Although the present invention has been described in the context of a preferred embodiment, it is not intended to limit the invention to the provided example. Modifications to the slide assembly 14, or alternative configurations, that are apparent to one of skill in the art are considered to be part of the present invention. For example, although the illustrated slide assembly 14 is arranged for vertical mounting applications, the present invention may also be adapted for horizontal, or other mounting configurations. In addition, the slide assembly 14 may be adapted for uses other than internet server mounting applications and, therefore, may take on alternative cross-sectional dimensions or lengths. Accordingly, the invention should be defined solely by the appended claims in light of the teachings of the disclosure.

What is claimed is:

1. A slide assembly, comprising:

a first slide segment configured to carry a load, said first slide segment having a web, a first transverse section and a second transverse section spaced from one another along said web, said first transverse section defining a first contact surface and said second transverse section defining a second contact surface;

a second slide segment telescopingly supporting said first slide segment;

a third slide segment configured to be connected to an object and carry said first and second slide segments, said third slide segment telescopingly supporting said second slide segment and including a web, a third transverse section and a fourth transverse section spaced from one another along said web, said third transverse section defining a third contact surface and said fourth transverse section defining a fourth contact surface, said slide assembly being movable from a retracted position to an extended position of said slide assembly wherein said second slide segment is at least partially withdrawn from said third slide segment;

a plurality of upper bearings and a plurality of lower bearings carried by said second slide segment at least one of said plurality of upper bearings and said plurality of lower bearings supporting substantially all load carried by said first slide segment when said slide assembly is in a fully retracted position, said upper bearings contacting both of said first contact surface and said third contact surface and said lower bearings contacting both of said second contact surface and said fourth contact surface when said slide assembly is in said retracted position.

2. The slide assembly of claim 1, wherein a portion of said upper and lower plurality of bearings are not in contact with either of said first slide segment and third slide segment when said slide is in said extended position.

3. The slide assembly of claim 1, wherein said second slide segment defines a web and a fifth and a sixth transverse section of said slide, said fifth transverse section substantially preventing vertical movement of said upper bearings and said sixth transverse section substantially preventing vertical movement of said lower bearings.

4. The slide assembly of claim 3, wherein said fifth transverse section comprises a first portion and a second portion, said first portion of said fifth transverse section substantially preventing downward movement of said upper bearings and said second portion of said fifth transverse section substantially preventing upward movement of said upper bearings and wherein said sixth transverse section comprises a first portion and a second portion, said first portion of said sixth transverse section substantially preventing upward movement of said lower bearings and said second portion of said sixth transverse section substantially preventing downward movement of said lower bearings.

5. The slide assembly of claim 4, wherein said first portion and said second portion of said fifth transverse section are formed from a single piece of material and wherein said first portion and said section portion of said sixth transverse section are formed from a single piece of material.

6. The slide assembly of claim 1, wherein said first contact surface and said third contact surface are separated by no more than two spherical surfaces and wherein said second contact surface and said fourth contact surface are separated by no more than two spherical surfaces.

7. The slide assembly of claim 1, wherein said upper bearings and said lower bearings are substantially aligned with a central, vertical plane passing through said slide assembly.

8. The slide assembly of claim 1, wherein said second slide segment is at least two-thirds the length of one of said first slide segment and said third slide segment.

9. The slide assembly of claim 1, wherein said second slide segment is at least three-fourths the length of one of said first slide segment and said third slide segment.

10. The slide assembly of claim 1, wherein said second slide segment is approximately the same length as one of said first slide segment and said third slide segment.

11. The slide assembly of claim 1, wherein said second slide segment is configured to withstand an operating load of at least thirty pounds without permanent deformation.

12. The slide assembly of claim 1, wherein said second slide segment is configured to withstand an operating load of at least seventy five pounds without permanent deformation.

13. The slide assembly of claim 1, wherein each of said upper plurality of bearings and said lower plurality of bearings comprise at least five bearings.

14. The slide assembly of claim 1, wherein each of said upper plurality of bearings and said lower plurality of bearings comprise at least ten bearings.

15. The slide assembly of claim 1, wherein each of said upper plurality of bearings and said lower plurality of bearings comprise at least fifteen bearings.

16. The slide assembly of claim 1, wherein each of said upper plurality of bearings and said lower plurality of bearings comprise at least twenty bearings.

17. A slide assembly, comprising:

a first slide segment having a web, a first transverse section and a second transverse section spaced from one another and extending in a first direction from said web defining a vertical inner surface, said first transverse section defining a first contact surface and said second transverse section defining a second contact surface;

a second slide segment telescopingly supporting said first slide segment;

a third slide segment telescopingly supporting said second slide segment and including a web defining a vertical inner surface, a third transverse section and a fourth transverse section spaced from one another and extending from said web in a second direction opposite said first direction, said third transverse section defining a third contact surface and said fourth transverse section defining a fourth contact surface, said slide assembly being movable from a retracted position to an extended position of said slide assembly wherein said second slide segment is at least partially withdrawn from said third slide segment;

a plurality of upper bearings and a plurality of lower bearings carried by said second slide segment, said upper bearings contacting both of said first contact surface and said third contact surface and said lower bearings contacting both of said second contact surface and said fourth contact surface when said slide assembly is in said retracted position, wherein an entirety of said upper bearings and said lower bearings are spaced inward in said first direction from said inner surface of said web of said first slide segment and spaced inward in said second direction from said inner surface of said web of said third slide segment, wherein said second slide segment defines a web and a fifth and a sixth transverse section of said slide, said fifth transverse section substantially preventing vertical movement of said upper bearings and said sixth transverse section substantially preventing vertical movement of said lower bearings;

wherein said fifth transverse section comprises a first portion and a second portion, said first portion of said filth transverse section substantially preventing downward movement of said upper bearings and said second portion of said fifth transverse section substantially preventing upward movement of said upper bearings and wherein said sixth transverse section comprises a first portion and a second portion, said first portion of said sixth transverse section substantially preventing upward movement of said lower bearings and said second portion of said sixth transverse section substantially preventing downward movement of said lower bearings.

18. The slide assembly of claim 17, wherein said first portion and said second portion of said fifth transverse section are formed from a single piece of material and wherein said first portion and said section portion of said sixth transverse section are formed from a single piece of material.

19. A slide assembly, comprising:

a first slide segment having a web, a first transverse section and a second transverse section spaced from one another and extending in a first direction from said web defining a vertical inner surface, said first transverse section defining a first contact surface and said second transverse section defining a second contact surface;

a second slide segment telescopingly supporting said first slide segment;

a third slide segment telescopingly supporting said second slide segment and including a web defining a vertical inner surface, a third transverse section and a fourth transverse section spaced from one another and extending from said web in a second direction opposite said first direction, said third transverse section defining a third contact surface and said fourth transverse section defining a fourth contact surface, said slide assembly being movable from a retracted position to an extended position of said slide assembly wherein said second slide segment is at least partially withdrawn from said third slide segment;

a plurality of upper bearings and a plurality of lower bearings carried by said second slide segment, said upper bearings contacting both of said first contact surface and said third contact surface and said lower bearings contacting both of said second contact surface and said fourth contact surface when said slide assembly is in said retracted position, wherein an entirety of said upper bearings and said lower bearings are spaced inward in said first direction from said inner surface of said web of said first slide segment and spaced inward in said second direction from said inner surface of said web of said third slide segment;

wherein said upper bearings and said lower bearings are substantially aligned with a central, vertical plane passing through said slide assembly.

20. A slide assembly, comprising:

a first slide segment configured to carry a load, said first slide segment having a web, a first transverse section and a second transverse section spaced front one another along said web, said first transverse section defining a first contact surface and said second transverse section defining a second contact surface;

a second slide segment telescopingly supporting said first slide segment;

a third slide segment configured to be connected to an object and carry said first and second slide segments, said third slide segment telescopingly supporting said second slide segment and including a web, a third transverse section and a fourth transverse section spaced from one another along said web, said third transverse section defining a third contact surface and said fourth transverse section defining a fourth contact surface, said slide assembly being movable from a retracted position to an extended position, wherein in said extended position said second slide segment is at least partially withdrawn from said third slide segment;

a plurality of upper bearings defining centers arranged in no more than one plane, said plane being substantially perpendicular to said web of one of said first slide segment and said third slide segment, and a plurality of lower bearings defining centers arranged in no more than one plane, said plane being substantially perpendicular to said web of one of said first slide segment and said third slide segment, said upper bearings and said lower bearings supporting said first slide segment relative to said third slide segment, at least one of said plurality of upper bearings and said plurality of lower bearings supporting substantially all load carried by said slide assembly when said slide assembly is in a fully refracted position.

21. The slide assembly of claim 20, wherein said centers of said upper bearings are aligned in no more than one line and said centers of said lower bearings are aligned in no more than one line.

22. The slide assembly of claim 20, wherein a portion of said upper and lower plurality of bearings are not in contact with either of said first slide segment and third slide segment when said slide is in said extended position.

23. The slide assembly of claim 20, wherein said second slide segment defines a web and a fifth and a sixth transverse section of said slide, said fifth transverse section substantially preventing vertical movement of said upper bearings and said sixth transverse section substantially preventing vertical movement of said lower bearings.

24. The slide assembly of claim 23, wherein said fifth transverse section comprises a first portion and a second portion, said first portion of said fifth transverse section substantially preventing downward movement of said upper bearings and said second portion of said fifth transverse section substantially preventing upward movement of said upper bearings and wherein said sixth transverse section comprises a first portion and a second portion, said first portion of said sixth transverse section substantially preventing upward movement of said lower bearings and said second portion of said sixth transverse section substantially preventing downward movement of said lower bearings.

25. The slide assembly of claim 24, wherein said first portion and said second portion of said fifth transverse section are formed from a single piece of material and wherein said first portion and said section portion of said sixth transverse section are formed from a single piece of material.

26. The slide assembly of claim 20, wherein said upper bearings and said lower bearings are substantially aligned with a central, vertical plane passing through said slide assembly.

27. The slide assembly of claim 20, wherein said second slide segment is at least two-thirds the length of one of said first slide segment and said third slide segment.

28. The slide assembly of claim 20, wherein said second slide segment is at least three-fourths the length of one of said first slide segment and said third slide segment.

29. The slide assembly of claim 20, wherein said second slide segment is approximately the same length as one of said first slide segment and said third slide segment.

30. The slide assembly of claim 20, wherein said second slide segment is configured to withstand an operating load of at least thirty pounds without permanent deformation.

31. The slide assembly of claim 20, wherein said second slide segment is configured to withstand an operating load of at least seventy five pounds without permanent deformation.

32. The slide assembly of claim 20, wherein each of said upper plurality of bearings and said lower plurality of bearings comprise at least five bearings.

33. The slide assembly of claim 20, wherein each of said upper plurality of bearings and said lower plurality of bearings comprise at least ten bearings.

34. The slide assembly of claim 20, wherein each of said upper plurality of bearings and said lower plurality of bearings comprise at least fifteen bearings.

35. The slide assembly of claim 20, wherein each of said upper plurality of bearings and said lower plurality of bearings comprise at least twenty bearings.

36. A slide assembly, comprising:

a first slide segment configured to carry a load, said first slide segment having a web, a first transverse section and a second transverse section spaced from one another along said web, said first transverse section defining a first contact surface and said second transverse section defining a second contact surface;

a second slide segment telescopingly supporting said first slide segment;

a third slide segment configured to be connected to an object and carry said first and second slide segments, said third slide segment telescopingly supporting said second slide segment and including a web, a third transverse section and a fourth transverse section spaced from one another along said web, said third transverse section defining a third contact surface and said fourth transverse section defining a fourth contact surface, said slide assembly being movable from a retracted position to an extended position of said slide assembly wherein said second slide segment is at least partially withdrawn from said third slide segment;

a plurality of upper bearings and a plurality of lower bearings carried by said second slide segment, at least one of said plurality of upper bearings and said plurality of lower bearings supporting substantially all load carried by said first slide segment when said slide assembly is in a fully retracted position, said upper bearings contacting both of said first contact surface and said third contact surface and said lower bearings contacting both of said second contact surface and said fourth contact surface when said slide assembly is in said retracted position, and wherein said second slide segment is at least two-thirds of the length of one of said first slide segment and said third slide segment.

37. The slide assembly of claim 36, wherein a portion of said upper and lower plurality of bearings are not in contact with either of said first slide segment and third slide segment when said slide is in said extended position.

38. The slide assembly of claim 36, wherein said second slide segment defines a web and a fifth and a sixth transverse section of said slide, said fifth transverse section substantially preventing vertical movement of said upper bearings and said sixth transverse section substantially preventing vertical movement of said lower bearings.

39. The slide assembly of claim 38, wherein said fifth transverse section comprises a first portion and a second portion, said first portion of said fifth transverse section substantially preventing downward movement of said upper bearings and said second portion of said fifth transverse section substantially preventing upward movement of said upper bearings and wherein said sixth transverse section comprises a first portion and a second portion, said first portion of said sixth transverse section substantially preventing upward movement of said lower bearings and said second portion of said sixth transverse section substantially preventing downward movement of said lower bearings.

40. The slide assembly of claim 39, wherein said first portion and said second portion of said fifth transverse section are formed from a single piece of material and wherein said first portion and said section portion of said sixth transverse section are formed from a single piece of material.

41. The slide assembly of claim 36, wherein said first contact surface and said third contact surface are separated by no more than two spherical surfaces and wherein said second contact surface and said fourth contact surface are separated by no more than two spherical surfaces.

42. The slide assembly of claim 36, wherein said upper bearings and said lower bearings are substantially aligned with a central, vertical plane passing through said slide assembly.

43. The slide assembly of claim 36, wherein said second slide segment is at least three-fourths the length of one of said first slide segment and said third slide segment.

44. The slide assembly of claim 36, wherein said second slide segment is approximately the same length as one of said first slide segment and said third slide segment.

45. The slide assembly of claim 36, wherein said second slide segment is configured to withstand an operating load of at least thirty pounds without permanent deformation.

46. The slide assembly of claim 36, wherein said second slide segment is configured to withstand an operating load of at least seventy five pounds without permanent deformation.

47. The slide assembly of claim 36, wherein each of said upper plurality of bearings and said lower plurality of bearings comprise at least five bearings.

48. The slide assembly of claim 36, wherein each of said upper plurality of bearings and said lower plurality of bearings comprise at least ten bearings.

49. The slide assembly of claim 36, wherein each of said upper plurality of bearings and said lower plurality of bearings comprise at least fifteen bearings.

50. The slide assembly of claim 36, wherein each of said upper plurality of bearings and said lower plurality of bearings comprise at least twenty bearings.

51. A slide assembly, comprising:

a first slide segment configured to carry a load, said first slide segment having a web, a first transverse section and a second transverse section spaced from one another along said web, said first transverse section defining a first contact surface and said second transverse section defining a second contact surface;

a second slide segment telescopingly supporting said first slide segment;

a third slide segment configured to be connected to an object and carry said first and second slide segments, said third slide segment telescopingly supporting said second slide segment and including a web, a third transverse section and a fourth transverse section spaced from one another along said web, said third transverse section defining a third contact surface and said fourth transverse section defining a fourth contact surface, said slide assembly being movable from a retracted position to an extended position, wherein in said extended position said second slide segment is at least partially withdrawn from said third slide segment;

a plurality of upper bearings defining centers arranged in no more than one plane, said plane being substantially perpendicular to said web of one of said first slide segment and said third slide segment, and a plurality of lower bearings defining centers arranged in no more than one plane, said plane being substantially perpendicular to said web of one of said first slide segment and said third slide segment, said upper bearings and said lower bearings supporting said first slide segment relative to said third slide segment, at least one of said plurality of upper bearings and said plurality of lower bearings supporting substantially all load carried by said slide assembly when said slide assembly is in a fully retracted position, and wherein said second slide segment is at least two-thirds the length of one of said first slide segment and said third slide segment.

52. The slide assembly of claim 51, wherein said centers of said upper bearings are aligned in no more than one line and said centers of said lower bearings are aligned in no more than one line.

53. The slide assembly of claim 51, wherein a portion of said upper and lower plurality of bearings are not in contact with either of said first slide segment and third slide segment when said slide assembly is in said extended position.

54. The slide assembly of claim 51, wherein said second slide segment defines a web and a fifth and a sixth transverse section of said slide assembly, said fifth transverse section substantially preventing vertical movement of said upper bearings and said sixth transverse section substantially preventing vertical movement of said lower bearings.

55. The slide assembly of claim 54, wherein said fifth transverse section comprises a first portion and a second portion, said first portion of said filth transverse section substantially preventing downward movement of said upper bearings and said second portion of said fifth transverse section substantially preventing upward movement of said upper bearings and wherein said sixth transverse section comprises a first portion and a second portion, said first portion of said sixth transverse section substantially preventing upward movement of said lower bearings and said second portion of said sixth transverse section substantially preventing downward movement of said lower bearings.

56. The slide assembly of claim 55, wherein said first portion and said second portion of said fifth transverse section are formed from a single piece of material and wherein said first portion and said section portion of said sixth transverse section are formed from a single piece of material.

57. The slide assembly of claim 51, wherein said upper bearings and said lower bearings are substantially aligned with a central, vertical plane passing through said slide assembly.

58. The slide assembly of claim 51, wherein said second slide segment is at least three-fourths the length of one of said first slide segment and said third slide segment.

59. The slide assembly of claim 51, wherein said second slide segment is approximately the same length as one of said first slide segment and said third slide segment.

60. The slide assembly of claim 51, wherein said second slide segment is configured to withstand an operating load of at least thirty pounds without permanent deformation.

61. The slide assembly of claim 51, wherein said second slide segment is configured to withstand an operating load of at least seventy five pounds without permanent deformation.

62. The slide assembly of claim 51, wherein each of said upper plurality of bearings and said lower plurality of bearings comprise at least five bearings.

63. The slide assembly of claim 51, wherein each of said upper plurality of bearings and said lower plurality of bearings comprise at least ten bearings.

64. The slide assembly of claim 51, wherein each of said upper plurality of bearings and said lower plurality of bearings comprise at least fifteen bearings.

65. The slide assembly of claim 51, wherein each of said upper plurality of bearings and said lower plurality of bearings comprise at least twenty bearings.

66. A slide assembly, comprising:

a first slide segment configured to carry a load, said first slide segment having a web, a first transverse section and a second transverse section spaced from one another along said web, said first transverse section defining a first contact surface and said second transverse section defining a second contact surface;

a second slide segment telescopingly supporting said first slide segment;

a third slide segment configured to be connected to an object and carry said first and second slide segments, said third slide segment telescopingly supporting said second slide segment and including a web, a third transverse section and a fourth transverse section spaced from one another along said web, said third transverse section defining a third contact surface and said fourth transverse section defining a fourth contact surface, said slide assembly being movable from a retracted position to an extended position, wherein in said extended position said second slide segment is at least partially withdrawn from said third slide segment;

a plurality of upper bearings and a plurality of lower bearings, each of said plurality of upper bearings and said plurality of lower bearings defining centers arranged substantially within a vertical, central plane of said slide assembly, said upper and lower bearing supporting substantially all load carried by said slide assembly, said upper bearings contacting both of said first contact surface and said third contact surface and said lower bearings contacting both of said second contact surface and said fourth contact surface when said slide assembly is in said retracted position, wherein said second slide segment defines a web and a fifth and a sixth transverse section of said slide assembly, said fifth transverse section substantially preventing vertical movement of said upper bearings and said sixth transverse section substantially preventing vertical movement of said lower bearings;

wherein said fifth transverse section comprises a first portion and a second portion, said first portion of said fifth transverse section substantially preventing downward movement of said upper bearings and said second portion of said fifth transverse section substantially preventing upward movement of said upper bearings and wherein said sixth transverse section comprises a first portion and a second portion, said first portion of said sixth transverse section substantially preventing upward movement of said lower bearings and said second portion of said sixth transverse section substantially preventing downward movement of said lower bearings.

67. The slide assembly of claim 66, wherein said first portion and said second portion of said fifth transverse section are formed from a single piece of material and wherein said first portion and said section portion of said sixth transverse section are formed from a single piece of material.

* * * * *